US006719444B1

(12) United States Patent
Alber et al.

(10) Patent No.: US 6,719,444 B1
(45) Date of Patent: Apr. 13, 2004

(54) VEHICULAR HEADLIGHTS

(75) Inventors: Frieder Alber, Eningen (DE); Henning Hogrefe, Walddorfhaeslach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/498,026

(22) Filed: Feb. 4, 2000

(30) Foreign Application Priority Data

Feb. 9, 1999 (DE) ..... 199 05 115

(51) Int. Cl.[7] ..... F21V 7/00

(52) U.S. Cl. ..... 362/518; 362/297; 362/310; 362/346

(58) Field of Search ..... 362/518, 517, 362/516, 297, 304, 346, 310

(56) References Cited

U.S. PATENT DOCUMENTS 4,520,433 A * 5/1985 Kosmatka ..... 362/516
6,068,391 A * 5/2000 Saladin et al. ..... 362/516

FOREIGN PATENT DOCUMENTS

DE 44 13 833 A1 11/1994

* cited by examiner

*Primary Examiner*—Stephen Husar
(74) *Attorney, Agent, or Firm*—Michael J. Striker

(57) ABSTRACT

A vehicular headlight includes at least one light source that emits light when in use, a reflector having a main reflection surface so positioned relative to the light source as to reflect any light reaching the same from the light source in the form of at least a low light beam delimited at least by an upper light/dark boundary at its upper region as considered in the position in which the headlight is to be used, and a light-transmitting plate extending across the path of the light beam at a distance from the light source and at least substantially devoid of any optically active profiles. A reflection element is further provided that is integral with the reflector and has an additional reflection surface deviating in configuration from that of the basic reflection surface to reflect any light reaching the same from the light source in the form of an additional light beam to an additional region situated upwardly of the upper light/dark boundary.

8 Claims, 2 Drawing Sheets

VEHICULAR HEADLIGHTS

BACKGROUND OF THE INVENTION

1. Field of the Invention

The present invention relates to illumination in general, and more particularly to vehicular headlights.

2. Description of the Related Art

There are already known various constructions of headlights for motor vehicles, among them those for motor vehicles that are designed for travel on paved roads, more often than not in close proximity to oncoming traffic moving in the opposite direction. In this scenario, it is important that the headlight issue a so-called low beam of light which is aimed in such a manner as to sufficiently illuminate the pavement ahead of the vehicle but not to dazzle or blind the driver of the oncoming vehicle. Of course, the headlight may also be, and almost without exception is, equipped to issue a so-called high beam as well which illuminates not only the roadway to a much greater distance in front of the vehicle but also a region at the side of the road and above the road where various signs depicting information that may be of value to the vehicle driver in navigating or maneuvering the vehicle may be located. Unfortunately, experience has shown that, with the prevalence of motor vehicles nowadays, the vehicle driver may have to cover substantial distances before being able to switch the high beams on without endangering himself or herself and the occupants of oncoming vehicles by dazzling or temporarily blinding their drivers. The low beam, on the other hand, due to its very nature, does a poor and inadequate job in illuminating such signs, especially the overhead ones.

This problem has already been recognized and dealt with before, for instance in the German patent publication DE 44 13 833 A1. This headlight serves for the issuance of at least the aforementioned low beam and includes a light source and a reflector. In the path of propagation of the light beam that is formed by the reflection of the light emitted by the light source by the reflecting surface of the reflector, there is arranged a light-transmissive plate which includes optical profiles by which the light rays of the light beam passing through the plate are deflected from their original courses. The reflector reflects the light of the light source that reaches it reflection surface in the form of a light beam that exhibits an upper light/dark boundary. This headlight is further provided with a reflection element by which the light emitted by the light source is reflected as an additional light beam propagating upwardly of the aforementioned upper light/dark boundary of the low light beam. The reflection element is provided on a light ray shutter which is coated with a reflective layer for this purpose. The intention is for the light reflected from the reflection element to illuminate a spatial region situated above the light/dark boundary without interference with the vision of the drivers of the oncoming vehicles approaching in the opposite direction of travel, so that especially overhead signs that are located high above the roadway are sufficiently illuminated. The light ray shutter that constitutes the reflection element in this patent document must be produced and mounted as a separate part and its position with respect to the other components of the headlight must be precisely adjusted so as to assure the illumination of, and only of, the desired spatial region by the additional light beam. This is a very laborious procedure which entails high manufacturing and assembly expenditures.

OBJECTS OF THE INVENTION

Accordingly, it is a general object of the present invention to avoid the disadvantages of the prior art.

More particularly, it is an object of the present invention to provide a headlight equipped to illuminate overhead signs when operated as a low light beam source, which headlight does not possess the drawbacks of the known headlights of this type.

Still another object of the present invention is to devise a headlight of the type here under consideration which does not require the performance of extensive and expensive adjustment operations.

It is yet another object of the present invention to design the above headlight in such a manner as to be able to dispense with previously required additional manufacturing and assembly steps.

A concomitant object of the present invention is so to construct the headlight of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a vehicular headlight which includes at least one light source that emits light when in use; a reflector having a main reflection surface so positioned relative to the light source as to reflect any light reaching the same from the light source in the form of at least a low light beam delimited at least by an upper light/dark boundary at its upper region as considered in the position in which the headlight is to be used; and a light-transmitting plate extending across the path of the light beam at a distance from the light source and at least substantially devoid of any optically active profiles. The headlight of the present invention further includes a reflection element integral with the reflector and having an additional reflection surface deviating in configuration from that of the basic reflection surface and reflecting any light reaching the same from the light source in the form of an additional light beam to an additional region situated upwardly of the upper light/dark boundary. A particular advantage of the present invention as described so far is that, due to the fact that the reflection element is constituted by an integral part of the reflector, there is no need for conducting any additional and separate manufacturing and/or assembly operation for the reflection element.

A particularly advantageous construction of the headlight of the present invention is obtained when the reflection element is arranged at a border region of the reflector, especially at a lower portion of such border region as considered in the position of use. This solution has the advantage that the configuration of the reflector is impaired to the least possible extent when the reflection element is located at such a region and/or portion. In this context, it is particularly advantageous when a fold is present at least at an upper portion of the transition between the additional reflection surface of the reflection element and the basic reflection surface of the reflector. This assures that no undesired reflections will occur at this transition region.

According to another advantageous aspect of the present invention, the additional reflection surface of the reflection element is at least substantially planar. However, it is also proposed by the present invention for the additional reflection surface of the reflection element to be concavely curved.

In accordance with another facet of the present invention, the width of the additional reflection surface of the reflection element in the horizontal direction is greater than the height of the additional reflection surface of the reflection element in the horizontal direction, both as considered in the position of use of the headlight. Last but not least, it is to be mentioned that an important feature of the present invention is that the additional reflection surface of the reflection element is so configured that the light emitted by the light source and reaching the same is reflected therefrom as a light beam that is horizontally dispersed as considered in the position of use.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
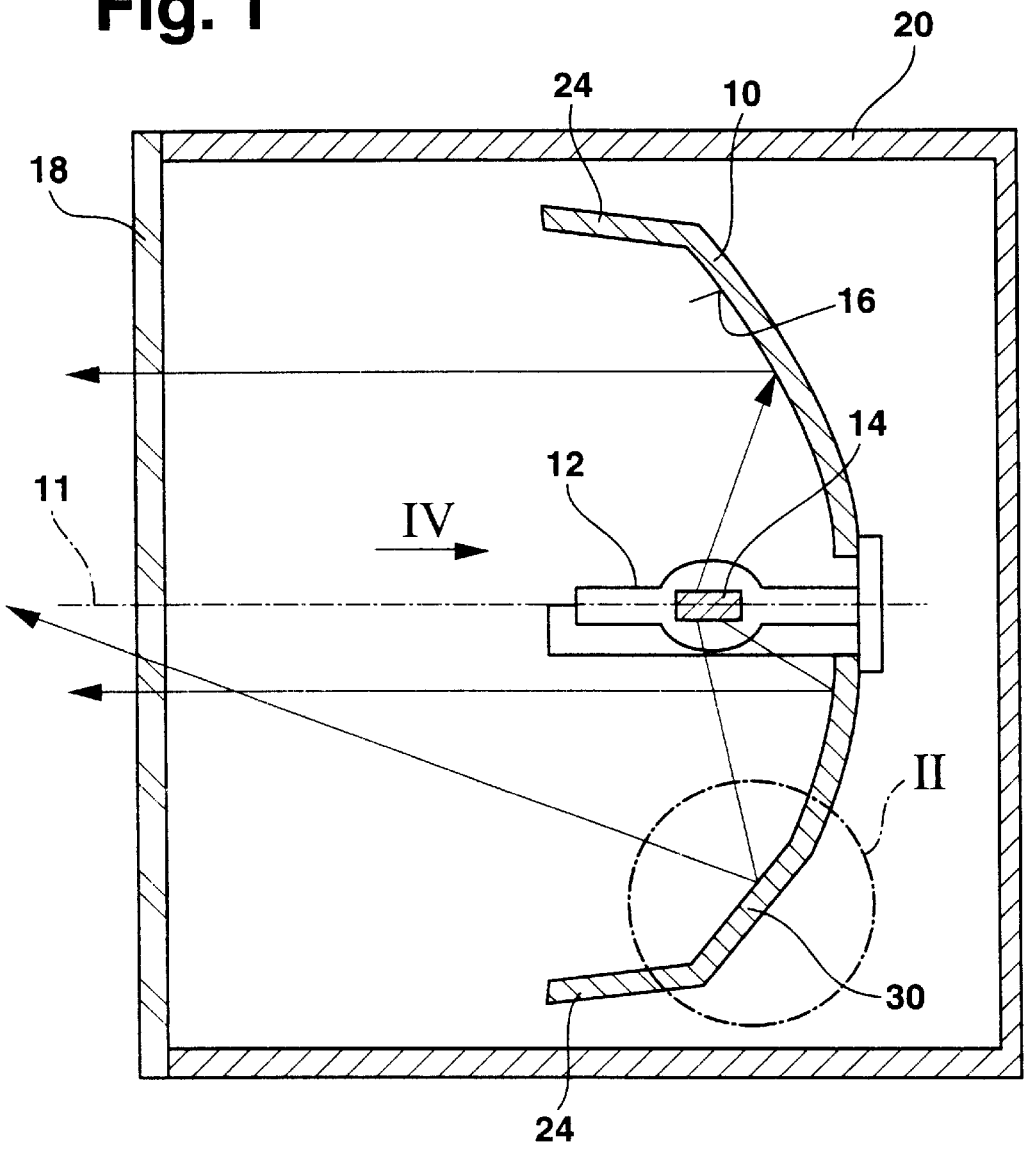
FIG. 1 is a vertical cross-sectional view of a motor vehicle headlight with a reflector embodying the present invention.
Figure 2:
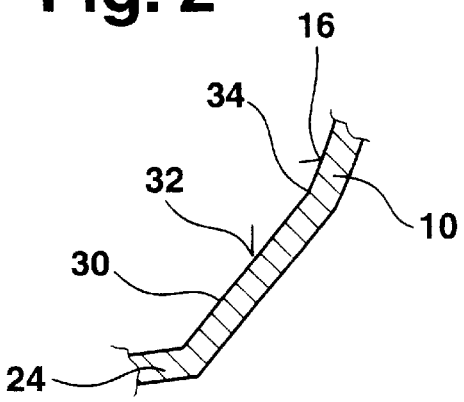
FIG. 2 is a cross-sectional view of a detail encircled and identified by the Roman numeral II in FIG. 1 and showing, on a somewhat enlarged scale, a first configuration of a reflection element of the present invention.
Figure 3:
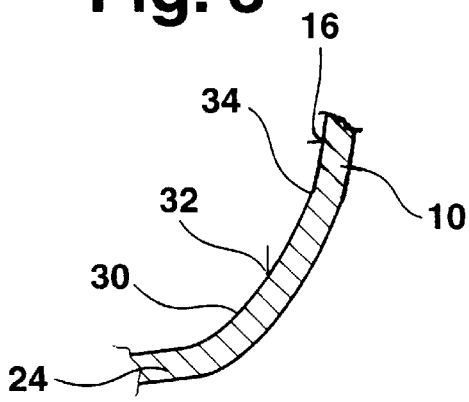
FIG. 3 is a view similar to that of FIG. 1 but showing a second configuration of the reflection element.

Referring now to the drawing in detail, and first to FIG. 1 thereof, it may be seen that it depicts a headlight for use on a motor vehicle, especially on one that is to travel on highways. This headlight as shown in a rather simplified fashion is to emit at least a so-called low beam. However, it is to be understood that the headlight may additionally serve one or more other purposes as well, such as the issuance of a so-called high beam and/or of a fog or bad weather light beam. As shown, this headlight includes as its main constituent components a reflector 10 that is generally concavely curved and a light source 12 that is situated in within the crest region of the reflector 10. Either an incandescent light bulb or a gas discharge lamp can be used as the light source 12 and its light-issuing body 14, that is the filament coil or the gas discharge arc formed during the operation, preferably extends at least substantially parallel to an optical axis 11 of the reflector 10. The reflector 10 is provided with a reflection surface 16 that is configured in such a manner that it reflects the light that the light source 12 emits towards it as a light beam that is aimed "low" (i.e. mostly toward the pavement just a relatively short distance ahead of the vehicle—hence the designation "low beam"). This low beam exhibits an upper light/dark boundary (between areas illuminated and not illuminated by the light beam) and has a predetermined illumination intensity distribution. A light-transmitting (i.e. at least translucent but preferably transparent) plate 18 is arranged in the paths of travel of the light rays of the low light beam reflected from the reflector 10. This plate 18 is at least substantially devoid of any optically effective profiles and thus is delimited both at its inner and at its outer side by at least substantially smooth surfaces. The reflector 10 may be mounted for positional adjustment within a housing 20 that has an exit opening. In that case, the light-transmitting plate 16 covers or spans this exit opening, being secured to the housing 20.

Figure 5:
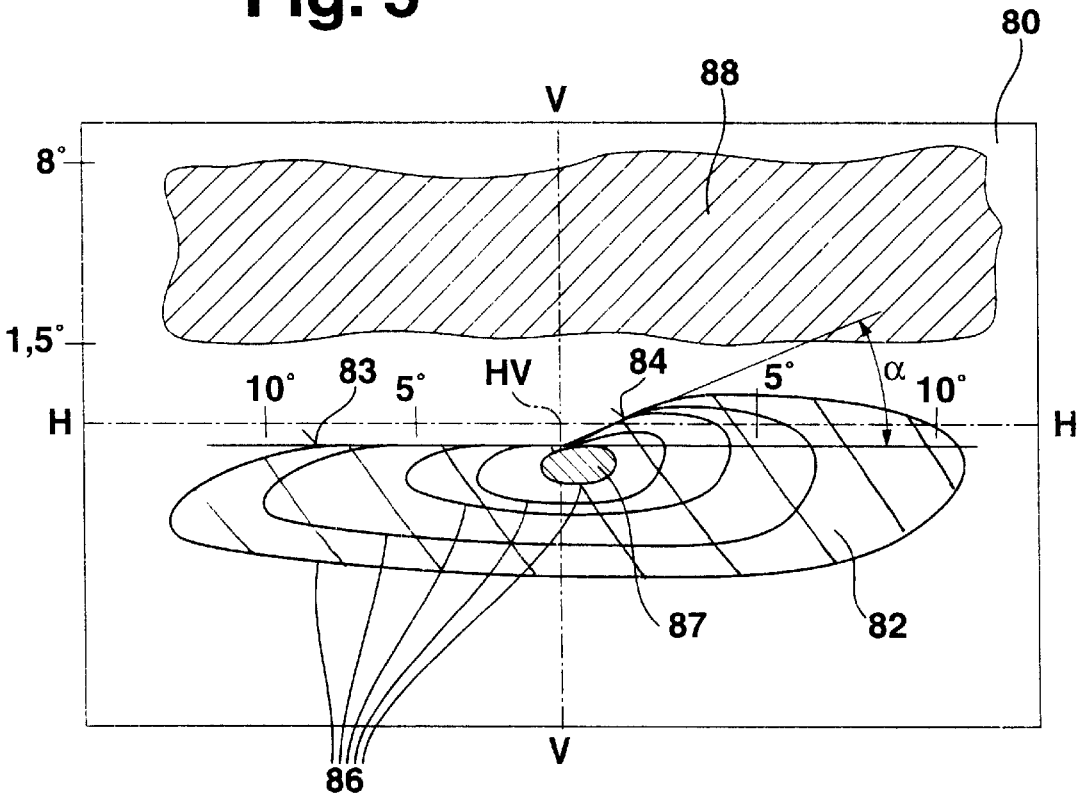
FIG. 5 is an elevational view illustrating in a diagrammatic manner a measuring shield as it appears when situated in front of and illuminated by the light emitted by the headlight of FIG. 1 and partially reflected by its reflector.

To elucidate the basic operation of the headlight, attention is now directed to FIG. 5 of the drawing, which shows an illumination pattern formed by the light beam issued by the headlight on a measurement shield or screen 80 that is disposed at a certain distance in front of the headlight. A line H—H is indicative of the horizontal central plane of the measurement screen 80, whereas a line V—V indicates the location of the vertical central plane of the screen 80. The horizontal plane and vertical plane lines H—H and V—V intersect each other at a point HV representative of the line at which such planes intersect. The low light beam emitted by the headlight following reflection from the reflector 10 illuminates the measurement screen 80 at a region 82 that is bounded in the upward direction as considered in the intended mounted position of the headlight by a light/dark boundary 83, 84. The headlight with the pattern depicted in FIG. 5 is designed for use on a vehicle intended to generally travel on the right-hand side of the road. The light/dark boundary 83, 84 includes at the side closer to the oncoming traffic approaching in the opposing travel direction, that is on the left side of the illustrated pattern for the right-hand vehicular traffic, a portion 83 that extends substantially horizontally and is located a certain distance below the horizontal line H—H. On the vehicle's own side, that is at the right side of the measurement screen for the illustrated headlight destined for right-hand traffic, the light/dark boundary 83, 84 includes a section 84 which commences at the horizontal portion 83 in the vicinity of the point HV and rises to the right at an angle $\alpha$ of about 15°. The distribution of the illumination intensity within the region 82 is indicated by several lines 86 connecting loci of the same illumination intensity; the highest illumination intensity is encountered in a zone 87 situated underneath the light/dark line 83, 84 and somewhat to the right of the vertical central plane represented by the line V—V. The reflector 10 is configured in such a manner as to reflect the light emanating from the light source 12 as to form the illustrated pattern on the measurement screen 80, including the illuminated region 62 with its upper light/dark boundary 83, 84 and the illustrated illumination intensity distribution on its own, without necessitating or needing the presence of any optically active profiles on the plate 18.

The headlight of the present invention further includes at least one reflection element 30 that is integral or of one piece with the reflector 10 and serves the purpose of providing illumination of an additional region 88 situated on the screen 80 upwardly of the region 80 illuminated by the aforementioned light beam as reflected by the reflector 30. The additional illumination region 88 is situated upwardly of and at a spacing from the horizontal portion 83 of the light/dark boundary 83, 84 of the illumination region 82 and extends to both sides of the central vertical plane indicated by the line V—V. The width of the additional region 88 in the horizontal direction is considerably greater than its height in the vertical direction. The additional region 88 preferably extends in the vertical direction from about 1.5° to about 8° upwardly of the central horizontal plane indicated by the line H—H and in the horizontal direction to at least 8° to each side of the central vertical plane represented by the line V—V. The illumination in the additional region is to be at least about 0.1 lux (about 0.0093 foot candle), and it must not exceed about 0.7 lux (about 0.065 foot candle). In actual use of the vehicle equipped with the headlight of this construction, overhead signs, for instance traffic, directional, destination or warning signs, are typically to be found in the spatial region corresponding to the region 88 on the measurement screen 80; such signs are then illuminated by the additional light beam reflected from the reflection element 30.

Figure 4:
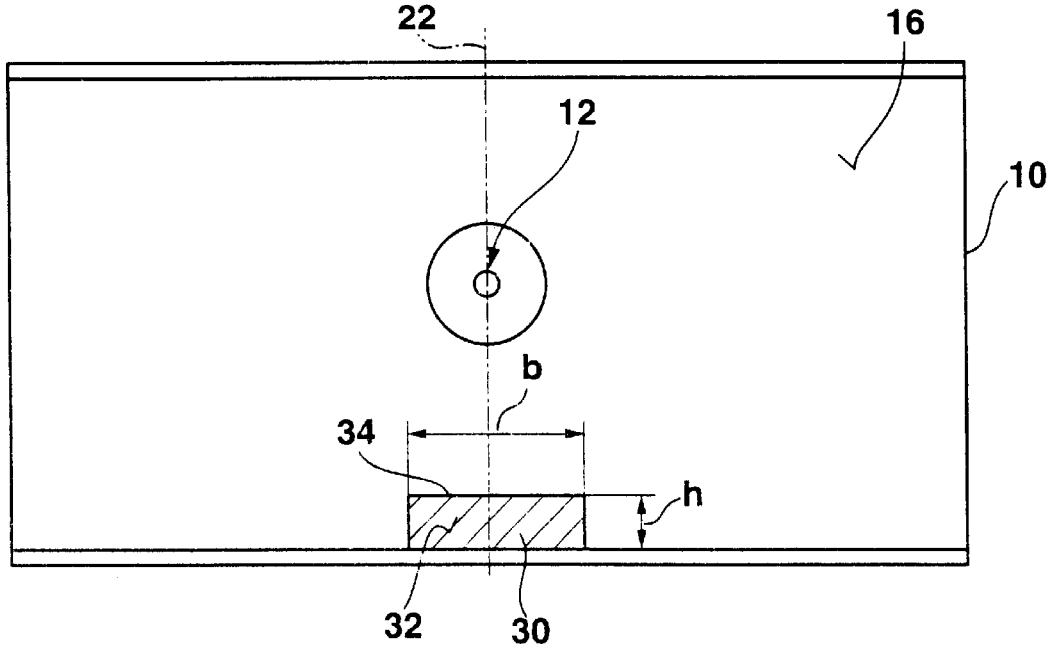
FIG. 4 is a front elevational view of the reflector taken in the direction of the arrow IV in FIG. 1.

In the following, a construction of the headlight will be described in which only a single reflection element 30 is present; however, it is self-evident that several such reflection elements 30 could be used instead. The illustrated reflection element 30 is arranged at a lower border region of the reflector 10, preferably at the region of a vertical central plane 22 of the reflector 10 below the light source 12, as indicated especially in FIG. 4 of the drawing. The reflection element 30 extends, for instance symmetrically, to the two sides of the vertical central plane 22; however, it can also be arranged asymmetrically with respect to this central vertical plane. The width b of the reflection element 30 in the horizontal direction preferably considerably exceeds its height h in the vertical direction. The reflection element 20 may be, for instance, situated at a distance of about 40 to 50 millimeters below the optical axis 11 and its height h may be between about 3 and 10 millimeters and its width b between about 10 and 40 millimeters.

When the reflection element 30 extends at least substantially horizontally and linearly, its height h in general determines the light intensity encountered at the region 88 on the measurement screen 80, that is the greater the height h the greater is the light intensity at the region 88. The width b of the reflection element 30, on the other hand, determines in general the width of the illuminated region 88 on the screen 80. The reflector 30 is shown especially in FIG. 1 of the drawing to be flanked at its upper end lower areas by respective at least substantially flat wall portions 24. The reflection element 30 extends,

What is claimed is:

1. A vehicular headlight comprising at least one light source that emits light when in use; a reflector having a main reflection surface so positioned relative to the light source as to reflect any light reaching the same from said light source in the form of at least a low light beam delimited at least by an upper light/dark boundary at its upper region as considered in the position in which the headlight is to be used; a light-transmitting plate extending across the path of said light beam at a distance from said light source and at least substantially devoid of any optically active profiles; and a reflection element integral with said reflector and having an additional reflection surface deviating in configuration from that of said basic reflection surface and specifically and controllably reflecting any light reaching the additional reflection surface from said light source to form an additional light beam directed to an additional, predefined region situated upwardly of said upper light/dark boundary, wherein said additional light beam forms a portion of a total light distribution generated by the headlight.

2. The headlight as defined in claim 1, wherein said reflector has a border region, and wherein said reflection element is arranged at said border region.

3. The headlight as defined in claim 1, wherein a fold is present at least at one portion of the transition between said additional reflection surface of said reflection element and said basic reflection surface of said reflector.

4. The headlight as defined in claim 1, wherein said reflector has a border region including a lower portion as considered in said position of use, and wherein said reflection element is arranged at said lower portion of said border region and a fold is present at least at an upper portion of the transition between said additional reflection element and said basic reflection surface of said reflector.

5. The headlight as defined in claim 1, wherein said additional reflection surface of said reflection element is at least substantially planar.

6. The headlight as defined in claim 1, wherein said additional reflection surface of said reflection element is concavely curved.

7. The headlight as defined in claim 1, wherein said additional reflection surface of said reflection element has a width and a height in the horizontal and vertical directions, respectively, as considered in said position of use, said width being greater than said height.

8. The headlight as defined in claim 1, wherein said additional reflection surface of said reflection element is so configured that the light emitted by said light source and reaching the same is reflected therefrom as a light beam that is horizontally dispersed as considered in said position of use.

* * * * *